US009370678B2

(12) United States Patent
Prusaitis

(10) Patent No.: US 9,370,678 B2
(45) Date of Patent: Jun. 21, 2016

(54) TABLE GYM

(71) Applicant: Daniel Paul Prusaitis, Glenview, IL (US)

(72) Inventor: Daniel Paul Prusaitis, Glenview, IL (US)

( * ) Notice: Subject to any disclaimer, the term of this patent is extended or adjusted under 35 U.S.C. 154(b) by 0 days.

(21) Appl. No.: 14/664,787

(22) Filed: Mar. 20, 2015

(65) Prior Publication Data

US 2016/0001116 A1 Jan. 7, 2016

Related U.S. Application Data

(60) Provisional application No. 61/929,631, filed on Jan. 21, 2014.

(51) Int. Cl.

| | |
|---|---|
| ***A63B 1/00*** | (2006.01) |
| ***A63B 21/072*** | (2006.01) |
| ***A63B 21/00*** | (2006.01) |
| ***A63B 21/068*** | (2006.01) |
| ***A63B 23/02*** | (2006.01) |
| ***A47B 3/14*** | (2006.01) |
| ***A47B 9/20*** | (2006.01) |
| ***A47B 13/08*** | (2006.01) |

(52) U.S. Cl.

CPC ... *A63B 1/00* (2013.01); *A47B 3/14* (2013.01); *A47B 9/20* (2013.01); *A47B 13/088* (2013.01); *A63B 21/00047* (2013.01); *A63B 21/068* (2013.01); *A63B 21/072* (2013.01); *A63B 21/4029* (2015.10); *A63B 23/0211* (2013.01); *A63B 23/0216* (2013.01); *A63B 2208/029* (2013.01); *A63B 2208/0247* (2013.01); *A63B 2208/0252* (2013.01); *A63B 2208/0295* (2013.01); *A63B 2210/50* (2013.01); *A63B 2225/09* (2013.01); *A63B 2225/093* (2013.01); *A63B 2225/10* (2013.01)

(58) Field of Classification Search

CPC ..... A63B 21/00047; A63B 21/4029–21/4031; A63B 2210/00; A63B 2210/50; A47B 2003/008; A47B 2003/145; A47B 3/04; A47B 13/088

USPC ..... 108/25, 33, 149

See application file for complete search history.

(56) References Cited

U.S. PATENT DOCUMENTS

| | | | | |
|---|---|---|---|---|
| 4,431,181 | A | 2/1984 | Baswell | |
| 5,257,701 | A | 11/1993 | Edelson | |
| 5,810,702 | A * | 9/1998 | Wilkinson | A63B 21/00047 482/130 |
| 6,971,975 | B2 * | 12/2005 | Croft | A63B 21/023 482/121 |

(Continued)

OTHER PUBLICATIONS

"Sexy Sculpted Arms & Modern Dining Table" http://daydecor.com/tag/interior design/ (Mar. 20, 2015), one page.

*Primary Examiner* — Oren Ginsberg
*Assistant Examiner* — Jennifer M Diechl

(57) ABSTRACT

A table gym and method of use is provided. The table gym may include a tabletop supported by a support frame, wherein the support frame provides telescoping portions movable from a retracted position to an extended position providing a plurality of inclinations of the tabletop. The table gym may include an upright standard with a flip-over pull-up bar that is pivotably connected to the tabletop so as to fold into and out of the tabletop upwardly facing surface. The tabletop may provide a folding ab bench removably attached thereto, wherein the ab bench may operatively engage the upright standard for performing various exercise routines. Alternatively, the ab bench could be move about the tabletop for performing other types of exercise routines or for eating and/or working at the tabletop.

20 Claims, 4 Drawing Sheets

(56) References Cited

U.S. PATENT DOCUMENTS

| | | | | |
|---|---|---|---|---|
| 7,878,954 | B2 * | 2/2011 | McBride | A63B 21/023 482/121 |
| 2004/0176227 | A1 * | 9/2004 | Endelman | A63B 21/154 482/142 |
| 2007/0066463 | A1 * | 3/2007 | Araujo | A63B 21/00181 482/142 |
| 2012/0283078 | A1 | 11/2012 | Solow | |
| 2015/0202483 | A1 * | 7/2015 | Ho | A63B 21/00069 482/122 |

* cited by examiner

TABLE GYM

CROSS-REFERENCE TO RELATED APPLICATION

This application claims the benefit of priority of U.S. provisional application No. 61/929,631, filed 21 Jan. 2014, the contents of which are herein incorporated by reference.

BACKGROUND OF THE INVENTION

The present invention relates to exercise equipment and, more particularly, to exercise equipment that transforms the very source of our sedentary, gluttonous lifestyles—the tables we work and eat at—into a multi-function exerciser.

Sedentary desk work and overeating have been found to be life-threatening. And individuals interested in exercising in the same space in which they work and eat, must currently choose between either using free weights, which requires a mess of plates and bars, which cause joint distress, or a multi-station exercise equipment machine that has the following disadvantages.

Existing multi-station exercise equipment machines take up excessive amounts of precious home or office space and/or such machines are too small and limited for exercise purposes; not offering sufficient options for calf and abdominal work, or stretching, or sufficient weight for power lifters. Moreover, many existing multi-function exercisers are unattractive eye-sores that people use space just to store out of sight.

Specifically, machines like the Total Gym and The Rack focus on portability and compactness to such an extent that the range of exercises and the amount of weight that they can bear are limited. The Rack All in One Gym requires bodyweight exercises that are too difficult for many or most people; or utilizes The Rack itself as a free weight, which at 30 lbs. is too light for many people to get a serious workout with.

Enormous machines like the BowFlex cannot possibly fit into most apartments or offices. Further, these machines tighten people up with exercise, but fail to provide the suite of stretching mechanisms to meet the needs of dancers, martial artists and all the people who recognize the benefits of flexibility.

As can be seen, there is a need for an exercise equipment that transforms the very source of our sedentary, gluttonous lifestyle—the tables we work and eat at—into a multi-function exerciser, so as to provide the size to enable highly rigorous exercise routines for all fitness levels yet returns to an attractive table after the workout. Every space that has a table can be a gym.

SUMMARY OF THE INVENTION

In one aspect of the present invention, a table gym exercising system includes a support frame providing a plurality of posts and a telescoping portion; a tabletop having opposing sides extending along its longitudinal axis from a distal end to a proximal end, wherein the distal end is supported on the plurality of posts and the proximal end is supported on the telescoping portion so that the telescoping portion is positionable from a retracted configuration to an extended configuration inclining the tabletop; two upright notches formed in the tabletop, each extending from the proximal end and along opposing sides thereof; a bar notch formed in the tabletop, extending perpendicularly between the two upright notches; an upright standard including: two parallel L-shaped vertical poles, each pole having a first end and an opposing second end, each first end pivotably connected to opposing sides of the proximal end of the tabletop; and a flip-over pull-up bar portion interconnecting the second ends so that the pull-up bar portion and the two vertical poles are received in the bar notch and the two upright notches, respectively, when the upright standard is pivoted to a collapsed configuration; and a folding ab bench including: a plurality of telescoping legs; and a bench top having a periphery supported on the telescoping legs, wherein a perimeter of the bench top is dimensioned to by snugly received by the bench cutout, whereby the folding ab bench is removably attached to the tabletop so that an upwardly facing surface of the bench top is generally flush with an upwardly facing surface of the tabletop.

In another aspect of the present invention, a table gym exercising system includes a support frame providing a plurality of posts and a telescoping portion; a tabletop having opposing sides extending along its longitudinal axis from a distal end to a proximal end, wherein the distal end is supported on the plurality of posts and the proximal end is supported on the telescoping portion so that the telescoping portion is positionable from a retracted configuration to an extended configuration inclining the tabletop, wherein the telescoping portion further provides a pin locking mechanism for locking the inclining tabletop at a plurality of elevations; two upright notches formed in the tabletop, each extending from the proximal end and along opposing sides thereof; a bar notch formed in the tabletop, extending perpendicularly between the two upright notches; and an upright standard including: two parallel L-shaped vertical poles, each pole having a first end and an opposing second end, each first end pivotably connected to opposing sides of the proximal end of the tabletop; and a flip-over pull-up bar portion interconnecting the second ends so that the pull-up bar portion and the two vertical poles are received in the bar notch and the two upright notches, respectively, when the upright standard is pivoted to a collapsed configuration, wherein the pull-up bar portion is pivotably connected to the second ends, wherein each vertical pole comprises an outer-most leg and a perpendicularly joined inner-most leg forming a L-shape, wherein the two inner-most leg are substantially flush with the tabletop and the two outer-most legs are substantially flush to the opposing sides in the collapsed configuration.

These and other features, aspects and advantages of the present invention will become better understood with reference to the following drawings, description and claims.

DETAILED DESCRIPTION OF THE INVENTION

Figure 1:
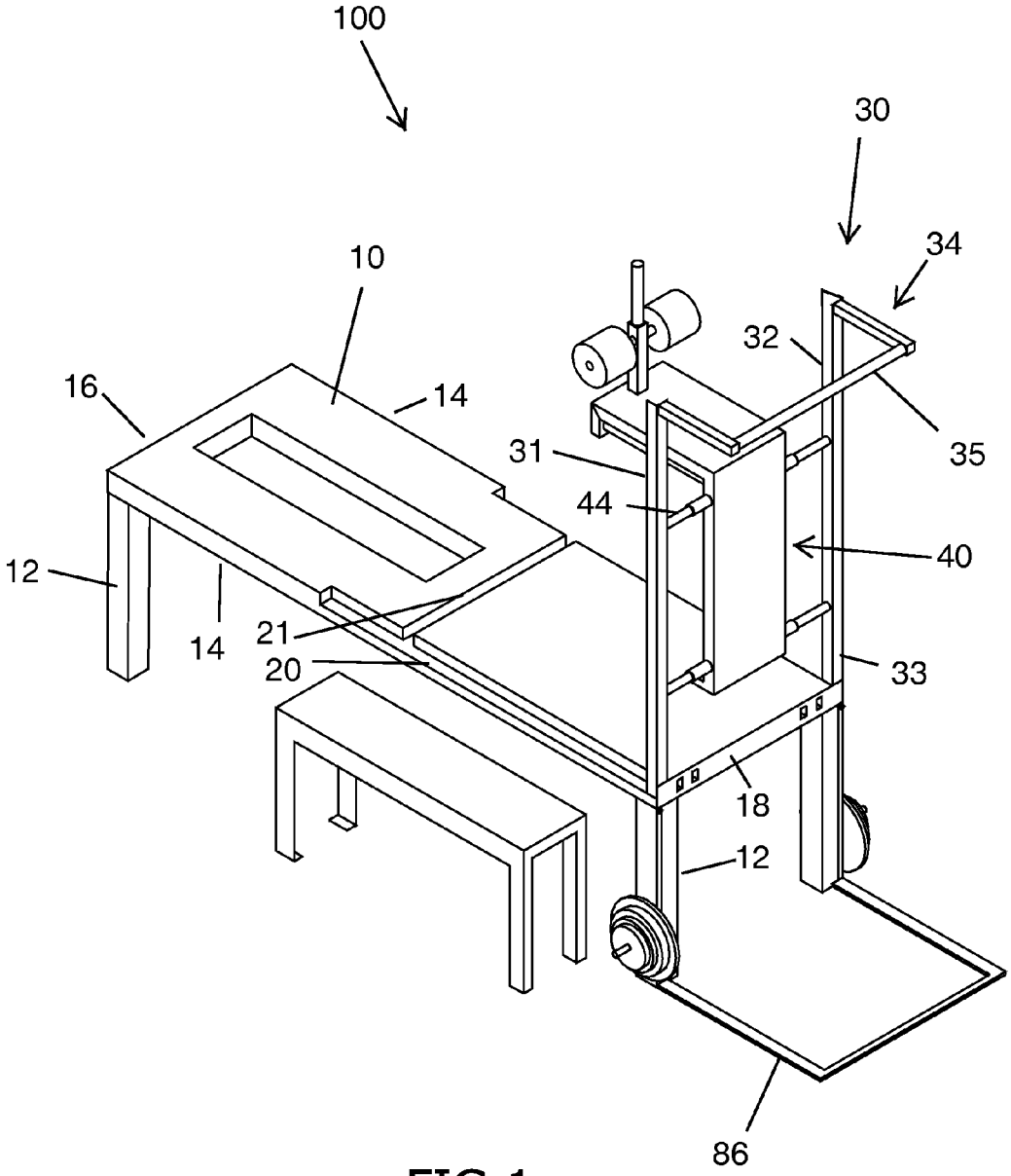
FIG. 1 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a table gym that transforms the very source of our sedentary, gluttonous lifestyle—the tables we work and eat at—into a multi-function exerciser, so that every space that has a table can be a gym. The table gym may include a tabletop supported by a support frame, wherein the support frame provides telescoping portions movable from a retracted position to an extended position providing a plurality of inclinations of the tabletop. The table gym may include an upright standard with a flip-over pull-up bar that is pivotably connected to the tabletop so as to fold into and out of the tabletop upwardly facing surface. The tabletop may provide a folding ab bench removably attached thereto, wherein the ab bench may operatively engage the upright standard for performing various exercise routines. Alternatively, the ab bench could be move about the tabletop for performing other types of exercise routines or for eating and/or working at the tabletop.

Referring to FIGS. 1 through 7, the present invention may include a table gym 100. The table gym 100 may include a tabletop 10 supported by a support frame 12.

The support frame 12 may include a plurality of posts 11 generally perpendicularly joined to a downwardly facing surface of the tabletop 10. The support frame 12 may include at least one telescoping post 13. The at least one telescoping post 13 may provide a telescoping portion 15 that slidably moves in and out of the telescoping post 13. The telescoping portion 15 may be movable from a retracted position to an extended position providing a plurality of inclinations of the tabletop 10, as illustrated FIG. 7. The at least one telescoping post 13 may be adapted to lock the tabletop 10 in the plurality of inclinations by using a locking mechanism. The locking mechanism may be a pin system 90 or equivalent. The pin system may include the includes a pin 92 adapted to be secured through two aligned pin holes, wherein one pin hole is disposed in the telescoping portion 15 and the other aligned pin hole is in the telescoping post 13. The tabletop 10 and the support frame 12 may provide a plurality of weight pegs 70 to receive weight plates 72. The weight plates may act as an anchor to the table gym 100 being exposed to the dead weight of a user during their exercise routines. The telescoping posts 13 may contain weight stacks, in which a user may insert pins to specify the weight they want to lift without the need for extra weight plates.

The tabletop 10 upwardly facing surface may be dimensioned and adapted to accommodate a human being for eating and working thereon. The tabletop 10 may be generally rectangular, though may be configured in any geometric shape so long as the tabletop 10 functions in accordance with the present invention as described herein. The tabletop 10 may have two opposing elongated sides 14 and a distal end 16 and an opposing proximal end 18. The tabletop 10 may form two, opposing upright notches 20 extending from the proximal end 18 toward the distal end 16 along both elongated sides 14, as shown in FIG. 1, in which the upright standard 30 may be folded down and concealed for normal table use in the collapsed configuration. A bar notch 22 may extend between the two opposing upright notches 20. The recesses formed by the notches 20, 22 may be filled with a panel that slides out of the tabletop 10, or in an alternative embodiment, slides up.

Figure 7:
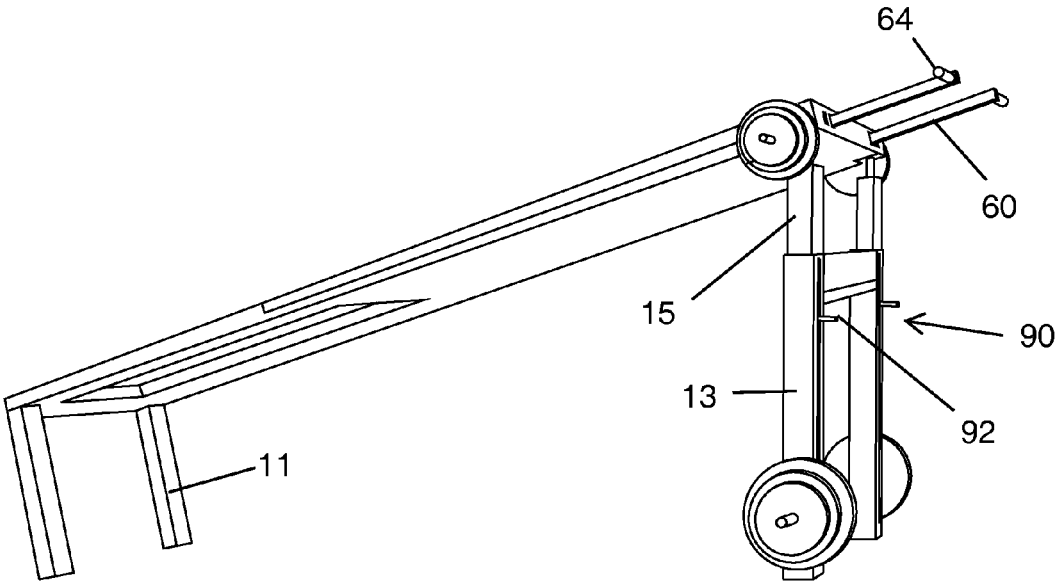
FIG. 7 is a perspective view of an exemplary embodiment of the present invention.

The tabletop 10 may include a plurality of retractable apertures 62 along the proximal end 18. Each retractable aperture 62 may slidably receive a retractable bar 60. A bar handle 64 may be disposed on each retractable bar 60, as illustrated in FIG. 7.

Figure 5:
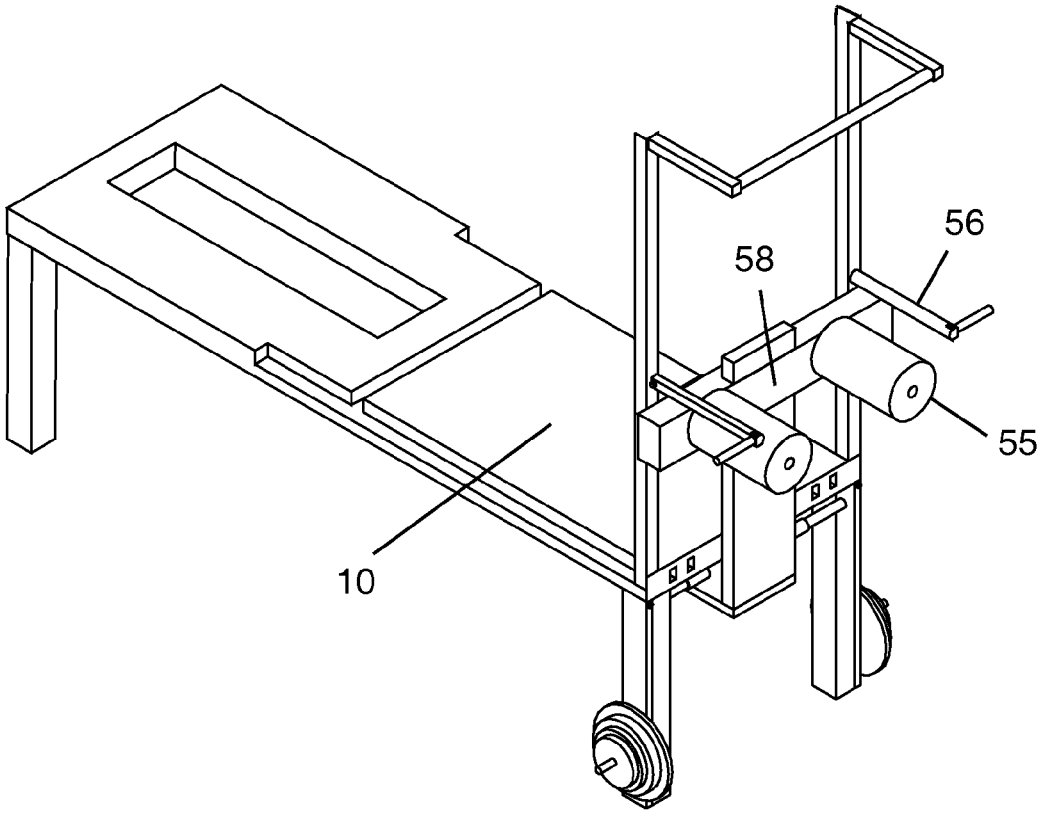
FIG. 5 is a perspective view of an exemplary embodiment of the present invention.
Figure 6:
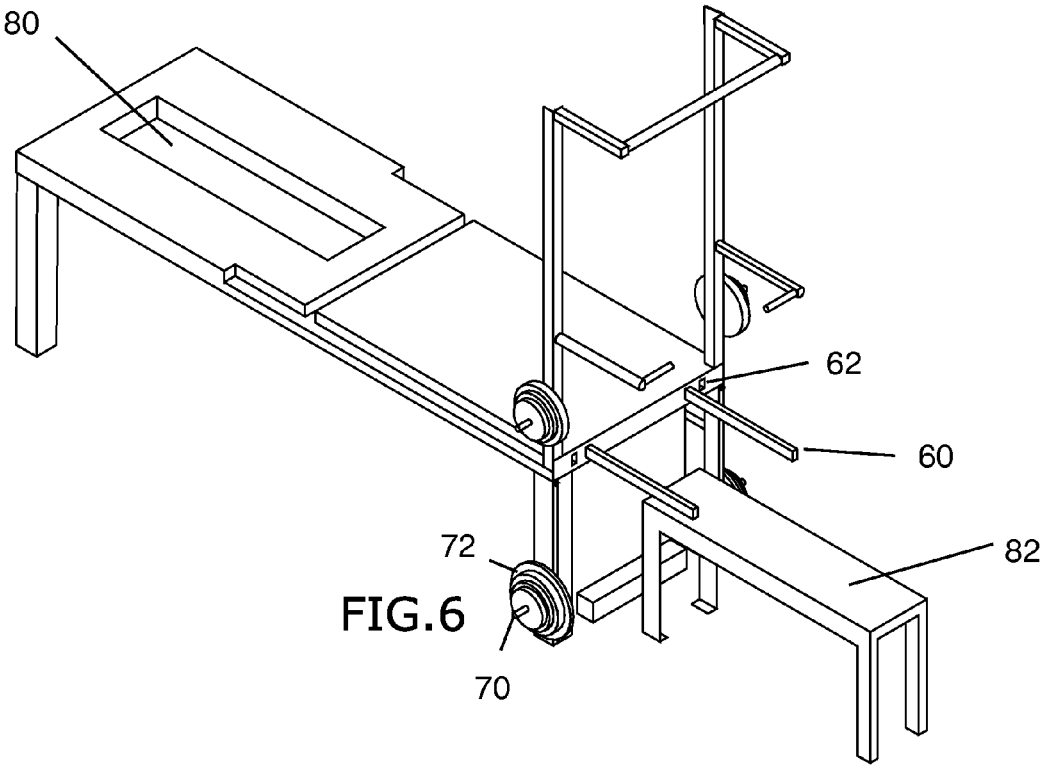
FIG. 6 is a perspective view of an exemplary embodiment of the present invention.

The table gym 100 may include an upright standard 30. The upright standard 30 may include two vertical poles 32 pivotably connected at the opposing corners of the proximal end 18 so that the upright standard 30 can be moved into a collapsed configuration along the tabletop 10. Each vertical pole 32 may have an "L-shape" formed by a inner-most leg 33 perpendicularly joined to an outer-most leg 31, as illustrated in FIGS. 5 and 6. Each leg 31, 33 may be dimensioned and adapted so when the poles 32 pivot onto the tabletop 10, the legs 31, 33 is received into its cooperating upright notch 20 recess so that the inner-most leg 33 is generally flush with the upwardly facing surface of the tabletop 10, and wherein the outer-most leg 31 is generally flush with a surface of each side 14 in the collapse configuration. Each outer-most leg 31 may provide a plurality of outer fastener areas facing the opposing outer-most leg 31. Each inner-most leg 33 may provide a plurality of inner fastener areas facing the away from the tabletop 10.

The upright standard 30 may include a flip-over pull-up bar 34 pivotably joined near an upper-most portion of each vertical pole 32, so that a pull-up bar portion 35 can be disposed generally parallel to the tabletop 10 at different elevations. In certain embodiments, the flip-over pull-up bar 34 may be locked at a plurality of such elevations by a locking mechanism. The pull-up bar portion 35 may be dimensioned and adapted so as to be locked in at a notch elevation so that when the vertical posts 32 are snugly received into their cooperating upright notches 20, the pull-up bar portion 35 is snugly received into its cooperating bar notch 22 recess.

The upright standard 30 may provide a plurality of handled bars 56 that are adapted to operatively engage the plurality of inner fastener areas so that a user may use the bars 56 for performing full-body weight exercise routines. The upright standard 30 may provide a fold-down stabilizer rectangle 86 attachable to the support frame 12 for the upright standard 30 to prevent a user from tipping up the end of the tabletop 10 during pull-ups and other excercises.

The table gym 100 may include a folding ab bench 40. The folding ab bench 40 may include a bench top, a plurality of telescoping legs 42 and a plurality of telescoping arms 44. The plurality of telescoping arms 44 may be disposed along a periphery of the bench top, as illustrated in FIG. 1. The plurality of telescoping arms 44 may be dimensioned and adapted so as to extend to the plurality of outer fastener areas along each outer-most leg 31 so as to operatively and securely extend between each outer-most leg 31, as illustrated in FIG. 1.

Figure 2:
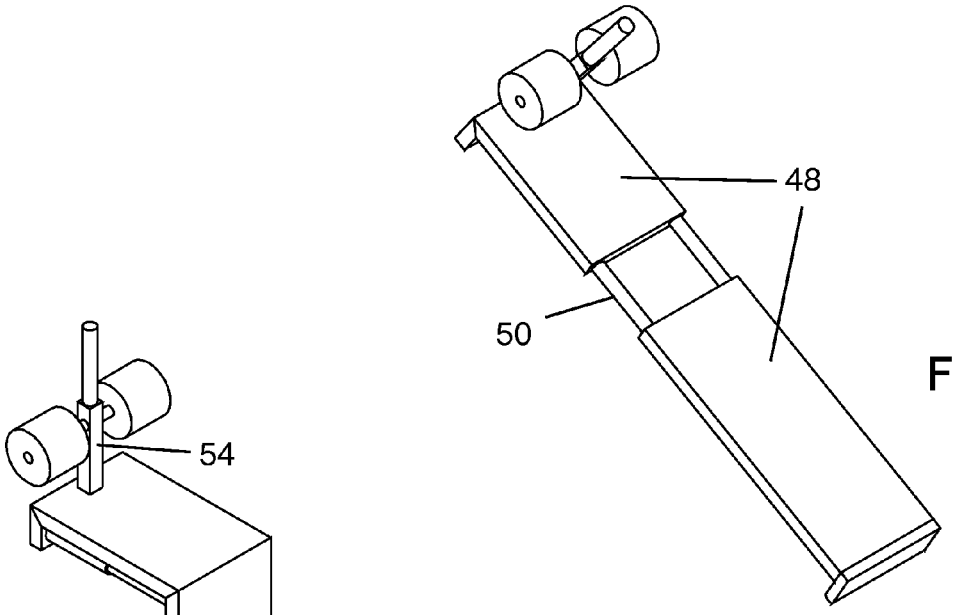
FIG. 2 is a perspective view of an exemplary embodiment of the present invention.
Figure 3:
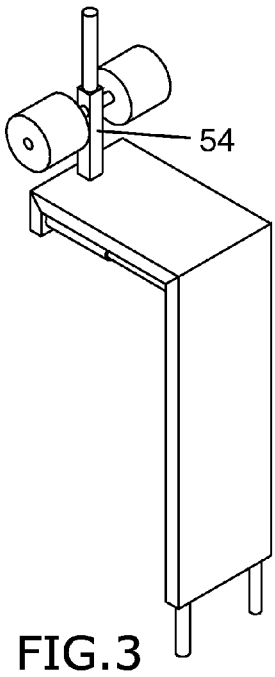
FIG. 3 is a perspective view of an exemplary embodiment of the present invention.
Figure 4:
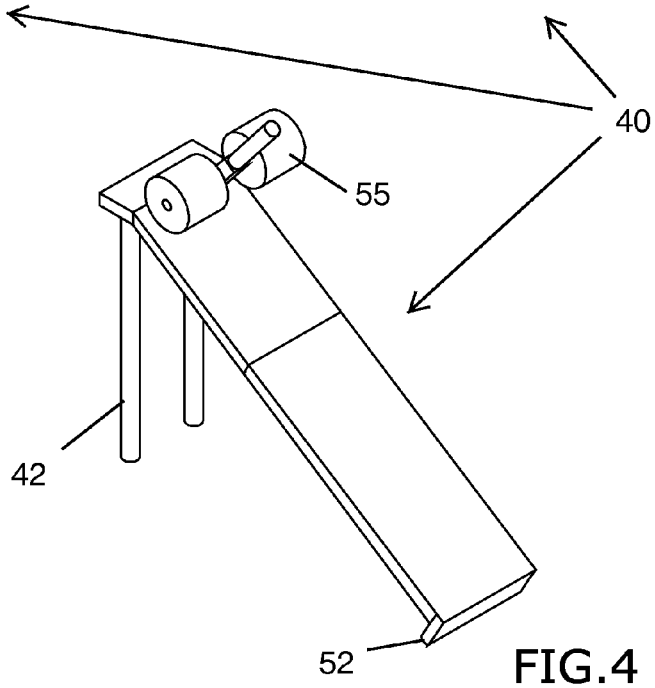
FIG. 4 is a perspective view of an exemplary embodiment of the present invention.

The bench top may be formed by at least two portions 48 slidably engaged along shared rails 50, as illustrated in FIG. 2. Each shared rail 50 may provide a pivotable connection so that separate portions 48 may be pivotally disposed relative to each other so as to form a generally perpendicular or L-shaped bench top, as illustrated in FIG. 3, including when the ab bench 40 may be operatively engaging the upright standard 30, as illustrated in FIG. 1. The plurality of telescoping legs 42 may be individually elongated to different, lengths so as to control a plurality of inclinations of the bench top, as illustrated FIG. 4. The telescoping legs 42 may provide a locking mechanism for locking predetermined inclination of the bench top.

The ab bench 10 may form a standard looking bench 82 that may be move about the tabletop 10 for performing various exercises. The ab bench 10 may be collapsible and adapted to be removably attached to and/or inserted into the tabletop 10 within a bench cutout 80 formed by the tabletop 10 so that the upwardly facing surface of the tabletop 10 and the bench top form a flush surface.

The bench top may be a generally rectangular shaped body having two opposing generally rectangular surfaces. When the bench top is pivoted, employed on the upright standard and/or removably attached to the tabletop 10, the two surfaces may alter their orientation from upwardly to downwardly, and vice versa.

A multi-pad 54 may include a support bar removably attached to two multi-pad cushions 55. The support bar may be removably connected to the bench top, as illustrated in FIG. 1 through 4. The multi-pad cushions 55 may be adjustably adapted to protect the shins of a user performing leg and/or for holding the feet of a user during abdominal exercises, wherein the multi-pad 54 may operatively engage a lower portion of legs of a human being. The ab bench 40 may provide stabilizers adapted to provide stability thereto.

The ab bench 40 and portions thereof 48, 50 may be adapted to be configured in a crucifix 58 that operatively engages the plurality of inner fastener areas, as illustrated in FIG. 5, so that a user may use the crucifix 58 for performing full-body weight exercise routines like squats with back support. The multi-pad cushions 55 may be disposed on the crucifix 58 so that a user's shoulders may press underneath the multi-pad cushions 55 and the user's spine press against an outer facing surface of the crucifix 58.

A method of using the present invention may include the following. A user may provide the table gym 100 as disclosed above so as to provide a plurality of exercise routines. For example, the user may lay on the bench top with the telescoping legs 42 folded so as to stretch their split, they can rock back and forth, thus increasing the mobility in their hip joints. As legs become looser C-pads are unbolted and moved to lower holes. In another instance, the tabletop 10 may provide a second option for dancers, martial artists, etc. working on their splits, where their knees are more bent, focusing the stretch deeper into the groin and away from the inner thighs as in the side of the table splits station.

It should be understood, of course, that the foregoing relates to exemplary embodiments of the invention and that modifications may be made without departing from the spirit and scope of the invention as set forth in the following claims.

What is claimed is:

1. A table gym exercising system comprising:

a support frame providing a plurality of posts and a telescoping portion;

a tabletop having opposing sides extending along a longitudinal axis from a distal end to a proximal end, wherein the distal end is supported on the plurality of posts and the proximal end is supported on the telescoping portion so that the telescoping portion is positionable from a retracted configuration to an extended configuration inclining the tabletop;

two upright notches formed in the tabletop, each extending from the proximal end and along opposing sides thereof;

a bar notch formed in the tabletop, extending perpendicularly between the two upright notches; and an upright standard comprising:

two parallel L-shaped vertical poles, each parallel L-shaped vertical pole having a first end and an opposing second end, each first end pivotably connected to opposing sides of the proximal end of the tabletop; and a flip-over pull-up bar portion interconnecting the second ends so that the flip-over pull-up bar portion and the two parallel L-shaped vertical poles are received in the bar notch and the two upright notches, respectively, when the upright standard is pivoted to a collapsed configuration.

2. The table gym exercising system of claim 1, wherein the telescoping portion further provides a locking mechanism for locking the tabletop at a plurality of elevations.

3. The table gym exercising system of claim 2, wherein the locking mechanism is a pin system.

4. The table gym exercising system of claim 1, wherein the pull-up bar portion is pivotably connected to the second ends.

5. The table gym exercising system of claim 1, wherein each parallel L-shaped vertical pole comprises an outer-most leg and a perpendicularly joined inner-most leg forming a L-shape, wherein the inner-most legs are substantially flush with the tabletop and the outer-most legs are substantially flush to the opposing sides in the collapsed configuration.

6. The table gym exercising system of claim 5, further comprising a plurality of outer fastener areas along each outer-most legs.

7. The table gym exercising system of claim 6, further comprising a bench cutout formed in the tabletop.

8. The table gym exercising system of claim 7, further comprising a folding ab bench, wherein the folding ab bench comprises:

a plurality of telescoping legs; and a bench top having a periphery supported on the plurality of telescoping legs, wherein a perimeter of the bench top is dimensioned to by snugly received by the bench cutout, whereby the folding ab bench is removably attached to the tabletop so that an upwardly facing surface of the bench top is generally flush with an upwardly facing surface of the tabletop.

9. The table gym exercising system of claim 8, further comprising a plurality of telescoping arms disposed along the periphery, wherein each telescoping arm is configured to removably secure to at least one outer fastener area.

10. The table gym exercising system of claim 9, further comprising a multi-pad disposed on the bench top, wherein the multi-pad is configured to operatively engage a lower portion of legs of a human being.

11. The table gym exercising system of claim 10, wherein the bench top further comprises a plurality of portions slidably engaged along shared rails so that the plurality of portions can be pivoted relative to each other.

12. The table gym exercising system of claim 8, wherein the plurality of telescoping legs further provide a locking mechanism configured to lock the bench top at a plurality of inclinations.

13. A table gym exercising system comprising:

a support frame providing a plurality of posts and a telescoping portion;

a tabletop having opposing sides extending along a longitudinal axis from a distal end to a proximal end, wherein the distal end is supported on the plurality of posts and the proximal end is supported on the telescoping portion so that the telescoping portion is positionable from a retracted configuration to an extended configuration inclining the tabletop;

two upright notches formed in the tabletop, each extending from the proximal end and along opposing sides thereof;

a bar notch formed in the tabletop, extending perpendicularly between the two upright notches;

an upright standard comprising:

two parallel L-shaped vertical poles, each parallel L-shaped vertical pole having a first end and an opposing second end, each first end pivotably connected to opposing sides of the proximal end of the tabletop; and a flip-over pull-up bar portion interconnecting the second ends so that the flip-over pull-up bar portion and the two parallel L-shaped vertical poles are received in the bar notch and the two upright notches, respectively, when the upright standard is pivoted to a collapsed configuration; and a folding ab bench comprising:

a plurality of telescoping legs; and a bench top having a periphery supported on the telescoping legs, wherein a perimeter of the bench top is dimensioned to by snugly received by the bench cutout, whereby the folding ab bench is removably attached to the tabletop so that an upwardly facing surface of the bench top is generally flush with an upwardly facing surface of the tabletop.

14. A table gym exercising system comprising:

a support frame providing a plurality of posts and a telescoping portion;

a tabletop having opposing sides extending along a longitudinal axis from a distal end to a proximal end, wherein the distal end is supported on the plurality of posts and the proximal end is supported on the telescoping portion so that the telescoping portion is positionable from a retracted configuration to an extended configuration inclining the tabletop, wherein the telescoping portion further provides a pin locking mechanism for locking the tabletop at a plurality of elevations;

two upright notches formed in the tabletop, each extending from the proximal end and along opposing sides thereof;

a bar notch formed in the tabletop, extending perpendicularly between the two upright notches; and an upright standard comprising:

two parallel L-shaped vertical poles, each parallel L-shaped vertical pole having a first end and an opposing second end, each first end pivotably connected to opposing sides of the proximal end of the tabletop; and a flip-over pull-up bar portion interconnecting the second ends so that the pull-up bar portion and the two parallel L-shaped vertical poles are received in the bar notch and the two upright notches, respectively, when the upright standard is pivoted to a collapsed configuration, wherein the flip-over pull-up bar portion is pivotably connected to the second ends, wherein each parallel L-shaped vertical pole comprises an outermost leg and a perpendicularly joined inner-most leg forming a L-shape, wherein the inner-most legs are substantially flush with the tabletop and the outermost legs are substantially flush to the opposing sides in the collapsed configuration.

15. The table gym exercising system of claim 14, further comprising a plurality of outer fastener areas along each outer-most legs.

16. The table gym exercising system of claim 15, further comprising a bench cutout formed in the tabletop.

17. The table gym exercising system of claim 16, further comprising a folding ab bench, wherein the folding ab bench comprises:

a plurality of telescoping legs; and a bench top having a periphery supported on the plurality of telescoping legs, wherein a perimeter of the bench top is dimensioned to by snugly received by the bench cutout, whereby the folding ab bench is removably attached to the tabletop so that an upwardly facing surface of the bench top is generally flush with an upwardly facing surface of the tabletop.

18. The table gym exercising system of claim 17, further comprising a plurality of telescoping arms disposed along the periphery, wherein each telescoping arm is configured to removably secure to at least one outer fastener area.

19. The table gym exercising system of claim 18, further comprising a multi-pad disposed on the bench top, wherein the multi-pad is configured to operatively engage a lower portion of legs of a human being.

20. The table gym exercising system of claim 19, wherein the bench top further comprises a plurality of portions slidably engaged along shared rails so that the plurality of portions can be pivoted relative to each other.

* * * * *